US010468826B2

(12) United States Patent
Zhao et al.

(10) Patent No.: US 10,468,826 B2
(45) Date of Patent: Nov. 5, 2019

(54) ELECTRICAL CONNECTOR HAVING AN IMPROVED TONGUE PORTION

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/111,244

(22) Filed: Aug. 24, 2018

(65) Prior Publication Data

US 2019/0067879 A1 Feb. 28, 2019

(30) Foreign Application Priority Data

Aug. 24, 2017 (CN) ..... 2017 1 0733097

(51) Int. Cl.

| | |
|---|---|
| ***H01R 13/6585*** | (2011.01) |
| ***H01R 13/6594*** | (2011.01) |
| ***H01R 13/6596*** | (2011.01) |
| ***H01R 13/502*** | (2006.01) |
| ***H01R 13/6593*** | (2011.01) |

(Continued)

(52) U.S. Cl.

CPC ..... *H01R 13/6585* (2013.01); *H01R 13/502* (2013.01); *H01R 13/533* (2013.01); *H01R 13/6593* (2013.01); *H01R 13/6594* (2013.01); *H01R 13/6596* (2013.01);

(Continued)

(58) Field of Classification Search

CPC ..... H01R 13/6585; H01R 13/6587; H01R 13/65802; H01R 23/688; H01R 23/7073; H01R 13/6594; H01R 13/6596; H01R 13/502; H01R 13/6593; H01R 13/533;

(Continued)

(56) References Cited

U.S. PATENT DOCUMENTS 7,794,263 B1 * 9/2010 Kim ..... H01R 13/741 439/357
9,350,126 B2 * 5/2016 Little ..... H01R 24/60

(Continued)

FOREIGN PATENT DOCUMENTS

CN 205178176 U 4/2016
CN 106129688 A 11/2016

(Continued)

*Primary Examiner* — Gary F Paumen

(74) *Attorney, Agent, or Firm* — Wei Te Chung; Ming Chieh Chang

(57) ABSTRACT

An electrical connector includes an insulative housing, a number of conductive terminals affixed to the insulative housing, and a shielding plate affixed to the insulative housing. The insulative housing includes a base portion and a mating tongue extending forwardly from the base portion. The conductive terminals are exposed to two opposite surfaces of the insulative housing. The conductive terminals are arranged in upper terminals and lower terminals in two rows. Each row of conductive terminals include a number of high frequency signal terminals. The insulative housing includes a number of receiving slots located at a peripheral edge thereof for inserting the shielding plate to shield between the two rows of conductive terminals.

20 Claims, 12 Drawing Sheets

(51) Int. Cl.

| | |
|---|---|
| ***H01R 13/533*** | (2006.01) |
| ***H01R 107/00*** | (2006.01) |
| ***H01R 24/60*** | (2011.01) |
| ***H01R 13/52*** | (2006.01) |
| ***H01R 13/6477*** | (2011.01) |

(52) U.S. Cl.
CPC ..... *H01R 13/5202* (2013.01); *H01R 13/6477* (2013.01); *H01R 24/60* (2013.01); *H01R 2107/00* (2013.01)

(58) Field of Classification Search
CPC ..... H01R 13/5202; H01R 13/6477; H01R 2107/00; H01R 24/60
USPC ..... 439/660, 607.05, 607.13
See application file for complete search history.

(56) References Cited

U.S. PATENT DOCUMENTS

| | | | | |
|---|---|---|---|---|
| 9,472,910 | B2 * | 10/2016 | Little | H01R 24/60 |
| 9,490,594 | B2 * | 11/2016 | Little | H01R 24/60 |
| 9,496,662 | B2 * | 11/2016 | Little | H01R 24/60 |
| 9,525,223 | B2 * | 12/2016 | Little | H01R 13/6658 |
| 9,525,227 | B2 * | 12/2016 | Little | H01R 13/6273 |
| 9,912,111 | B2 * | 3/2018 | Little | H01R 24/60 |
| 10,158,197 | B2 * | 12/2018 | Little | H01R 13/6597 |
| 10,170,870 | B2 * | 1/2019 | Little | H01R 13/405 |
| 10,199,776 | B2 * | 2/2019 | Cheng | H01R 13/6585 |
| 2015/0340798 | A1 * | 11/2015 | Kao | H01R 13/516<br>439/660 |
| 2016/0006196 | A1 * | 1/2016 | Zhong | H01R 24/60<br>439/638 |
| 2016/0315422 | A1 * | 10/2016 | Cheng | H01R 13/6581 |
| 2018/0006408 | A1 * | 1/2018 | Wen | H01R 24/60 |
| 2018/0013243 | A1 * | 1/2018 | Yao | H01R 13/6594 |
| 2018/0138642 | A1 * | 5/2018 | Kong | H01R 13/6594 |
| 2018/0205180 | A1 * | 7/2018 | Zhao | H01R 13/6582 |
| 2018/0212356 | A1 * | 7/2018 | Cheng | H01R 13/504 |

FOREIGN PATENT DOCUMENTS

| | | | |
|---|---|---|---|
| CN | 106159522 | A | 11/2016 |
| CN | 106252960 | A | 12/2016 |

* cited by examiner

ELECTRICAL CONNECTOR HAVING AN IMPROVED TONGUE PORTION

BACKGROUND OF THE DISCLOSURE

1. Field of the Disclosure

The present disclosure relates to an electrical connector, and more particularly to an electrical connector capable of preventing melting of plastic at high temperatures and shielding high frequency interference.

2. Description of Related Arts

China Patent No. 205178176 discloses an electrical connector including an insulative housing and a contact module assembled to the insulative housing. The contact module includes an upper contact module, a lower contact module, and a metal shielding plate sandwiched between the upper contact module and the lower contact module. The upper contact module includes an upper insulator and a number of upper terminals affixed to the upper insulator. The lower contact module includes a lower insulator and a number of lower terminals affixed to the lower insulator. The upper insulator, the lower insulator, and the metal shielding plate are integrated with each other by assembling. The upper insulator and the lower insulator are injection molded from plastic materials. The electrical connector is used for conveying high current and may cause safety hazards due to melting of the upper insulator and the lower insulator.

To solve the problem, China Patent No. 106129688 discloses an electrical connector replacing the insulative materials by ceramic materials. Due to the high sintering temperature of the ceramic, the risk of melting the plastic when the conductive terminal is at high temperature high is avoided. However the electrical connector could not shield high frequency signal interference in transmitting high frequency signals.

An improved electrical connector is desired.

SUMMARY OF THE DISCLOSURE

Accordingly, an object of the present disclosure is to provide an electrical connector capable of preventing melting of plastics at high temperatures and shielding high frequency interference.

To achieve the above object, an electrical connector comprises: an insulative housing comprising a base portion and a mating tongue extending forwardly from the base portion; a plurality of conductive terminals affixed to the insulative housing and exposed to two opposite surfaces of the insulative housing, the conductive terminals being arranged in upper terminals and lower terminals in two rows and each row including a plurality of high frequency signal terminals; and a shielding plate affixed to the insulative housing; wherein the insulative housing has a plurality of receiving slots at a peripheral edge thereof and using for inserting the shielding plate to shield between the two rows of conductive terminals.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
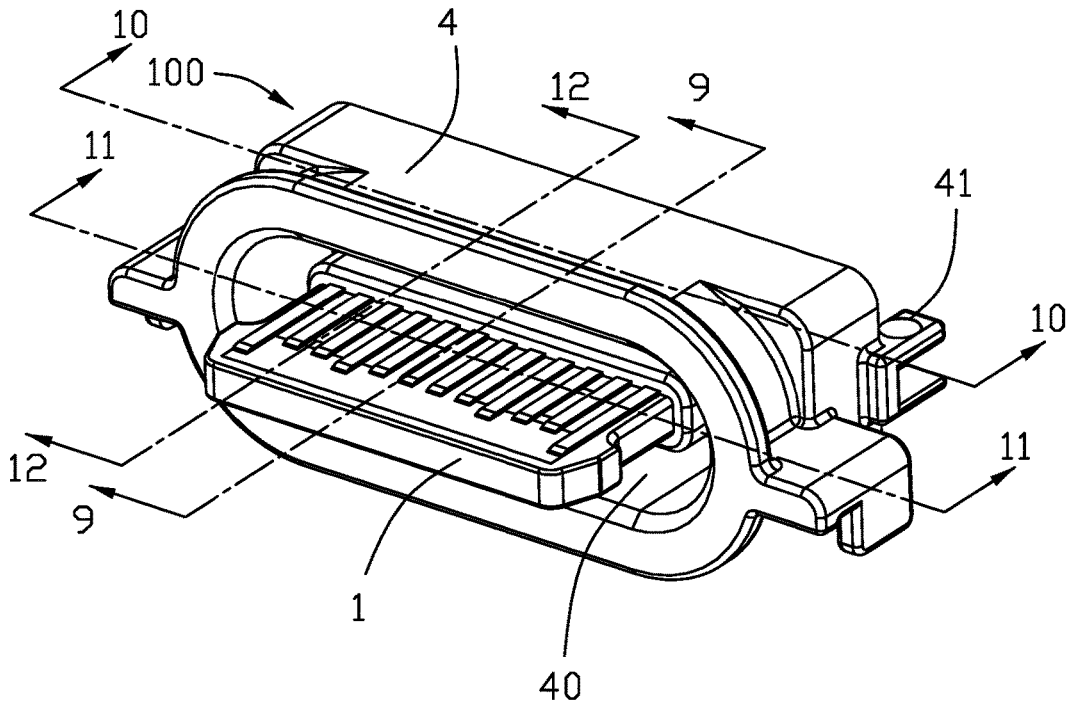
FIG. 1 is a perspective, assembled view of an electrical connector.
Figure 2:
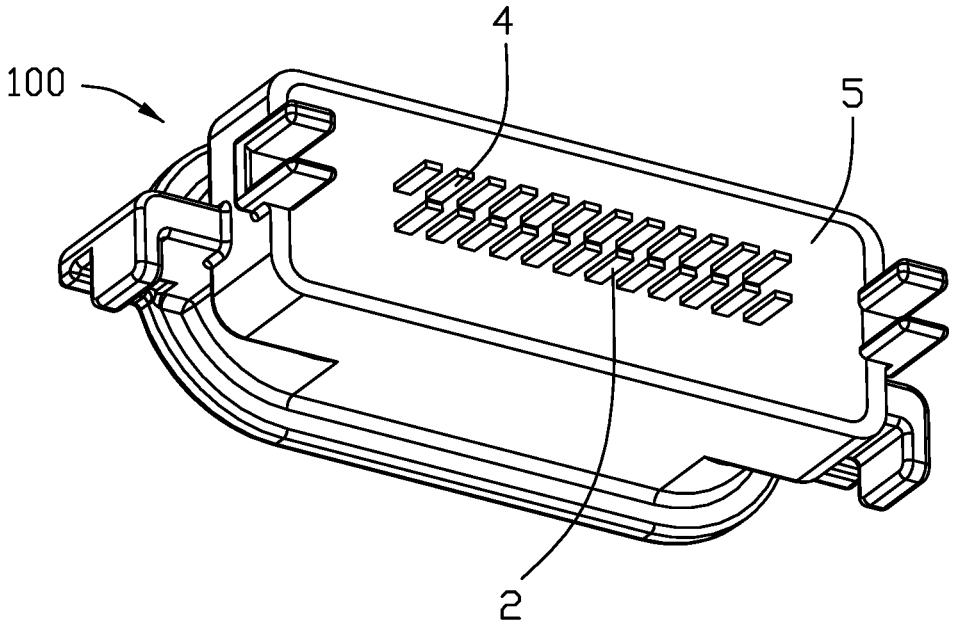
FIG. 2 is a another view of the electrical connector taken from FIG. 1.
Figure 3:
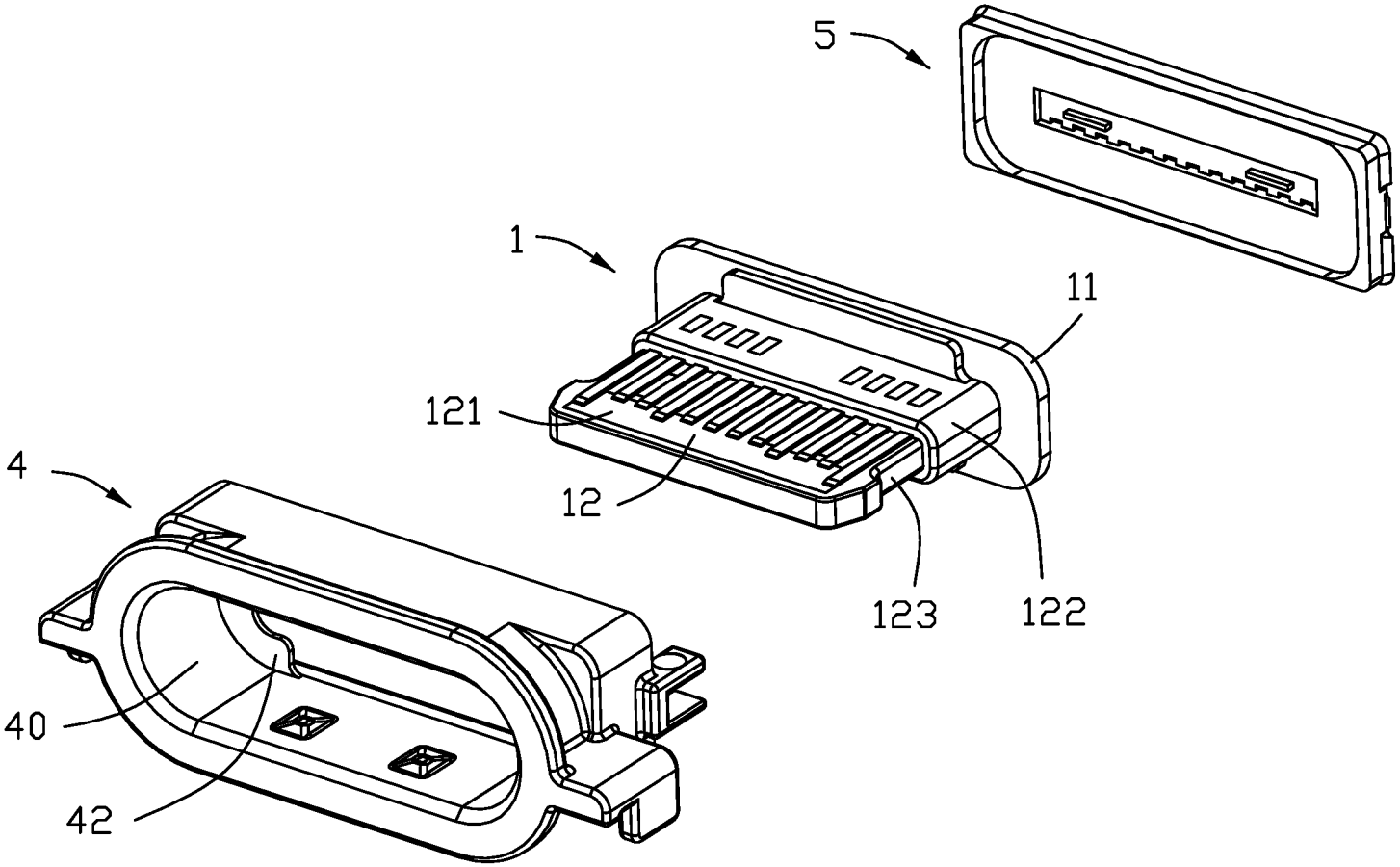
FIG. 3 is a partial exploded view of the electrical connector.

Reference will now be made in detail to the embodiments of the present disclosure. Referring to FIGS. 1 to 12, the electrical connector 100 includes a contact module 1, a shielding shell 4 enclosing the contact module 1, and a sealer 5 sealing a rear end of the electrical connector 100.

Referring to FIGS. 3 to 8, the contact module 1 includes an insulative housing having a base portion 11 and a mating tongue 12 extending forwardly from the base portion 11, a number of conductive terminals 2 affixed to the insulative housing, and a pair of shielding plates 3 affixed to the insulative housing. The mating tongue 12 includes a front tongue 121 and a rear thickened portion 122. The mating tongue 12 includes a pair of locking lateral edges 123 recessed in two lateral sides of the mating tongue 12. In the preferred embodiment, the front tongue 121 is made of ceramic materials and the rear thickened portion 122 is made of insulative materials. In other embodiment, the front tongue 121 and the rear thickened portion 122 are made of ceramic materials.

Figure 4:
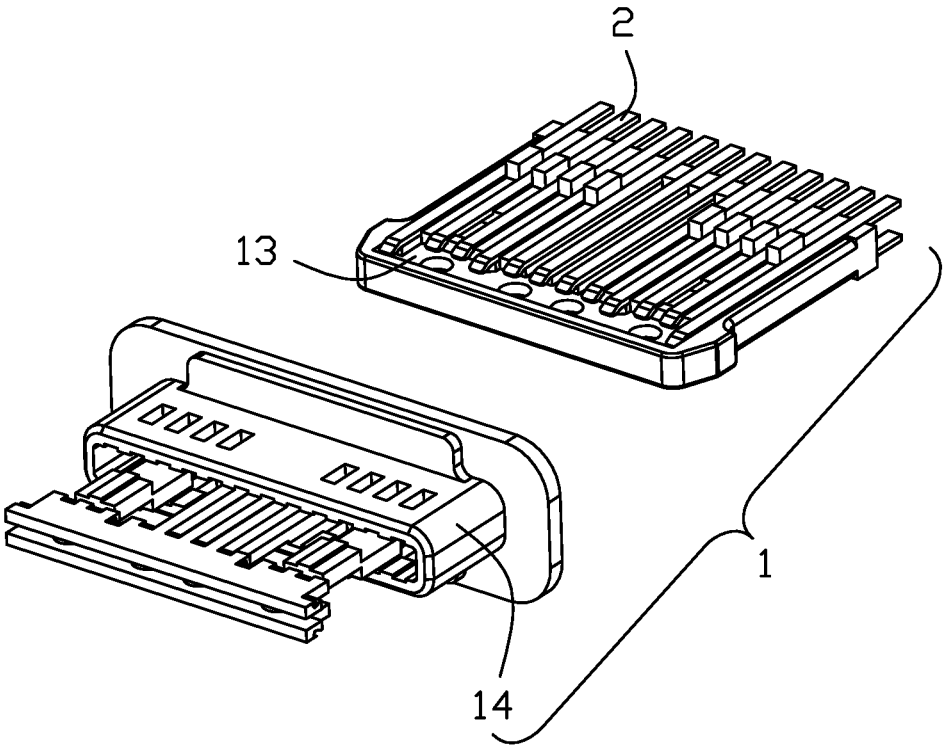
FIG. 4 is a partial exploded view of a contact module of the electrical connector.
Figure 5:
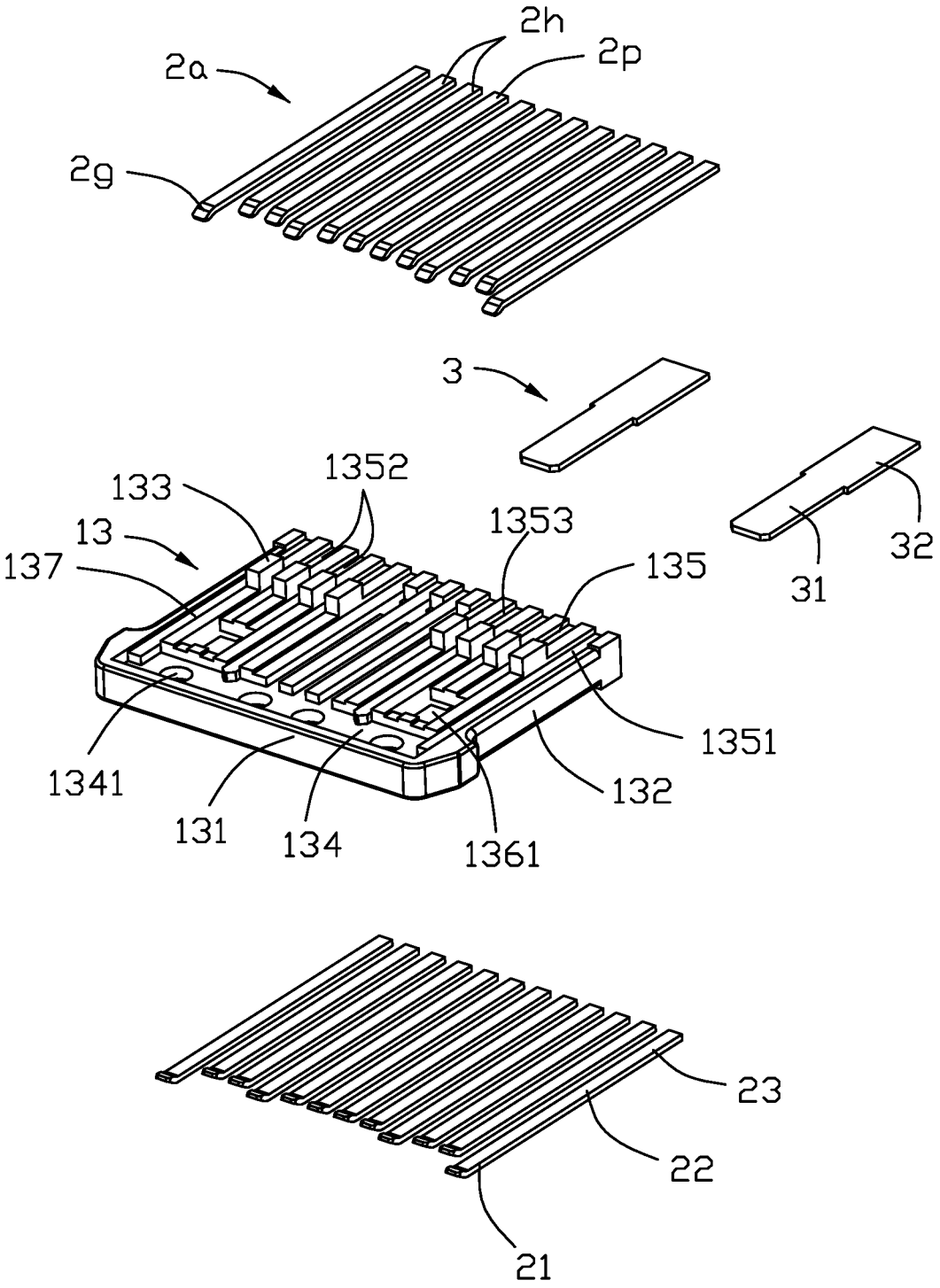
FIG. 5 is a further exploded view of the contact module taken from FIG. 4.
Figure 6:
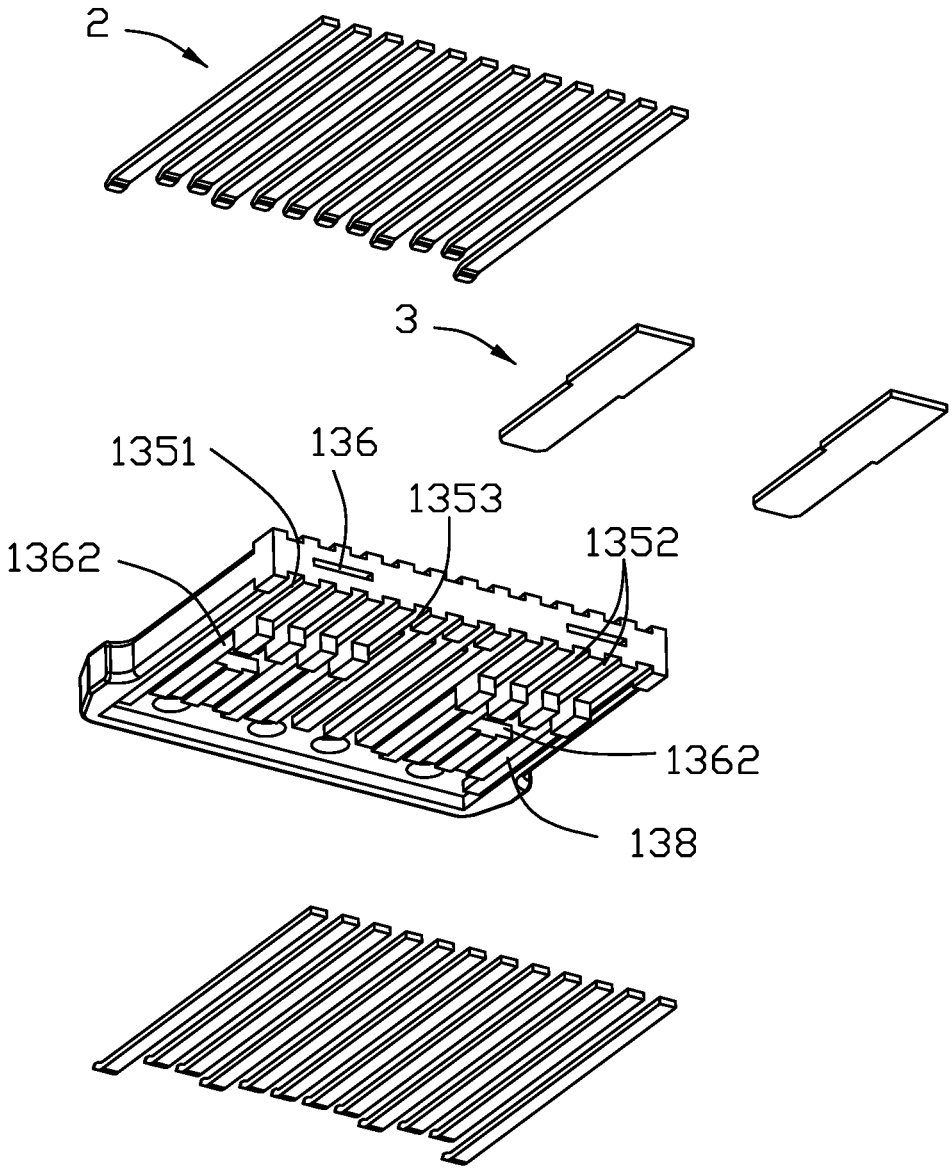
FIG. 6 is another view of the contact module taken from FIG. 5.
Figure 7:
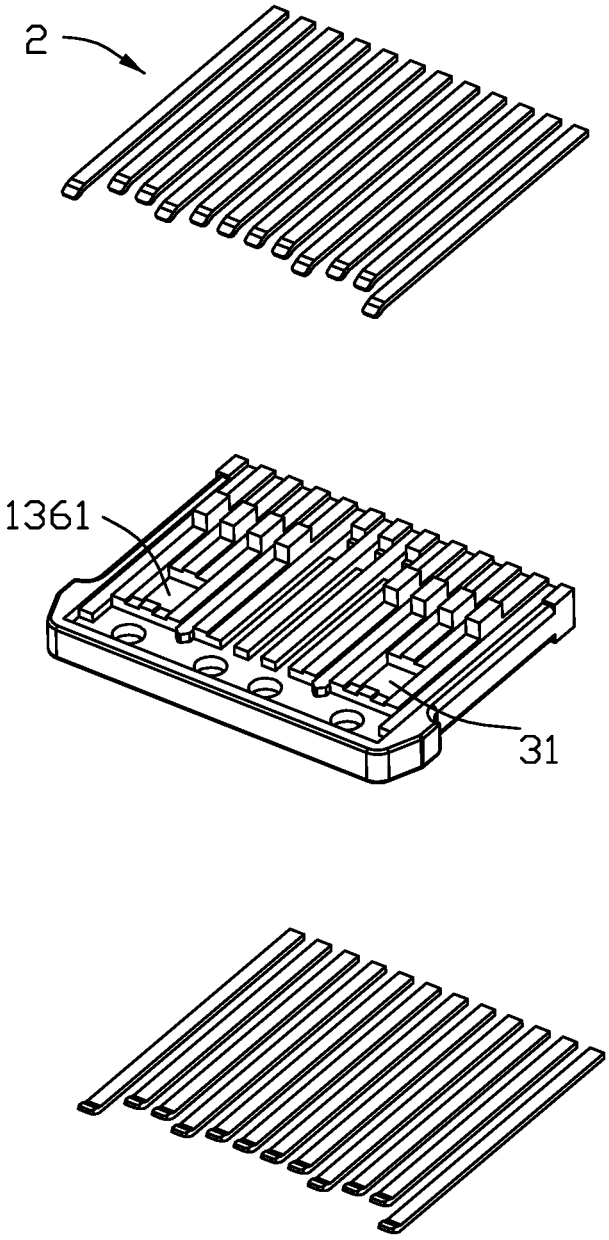
FIG. 7 is an exploded view of a ceramic flat portion and a number of conductive terminals of the electrical connector.
Figure 8:
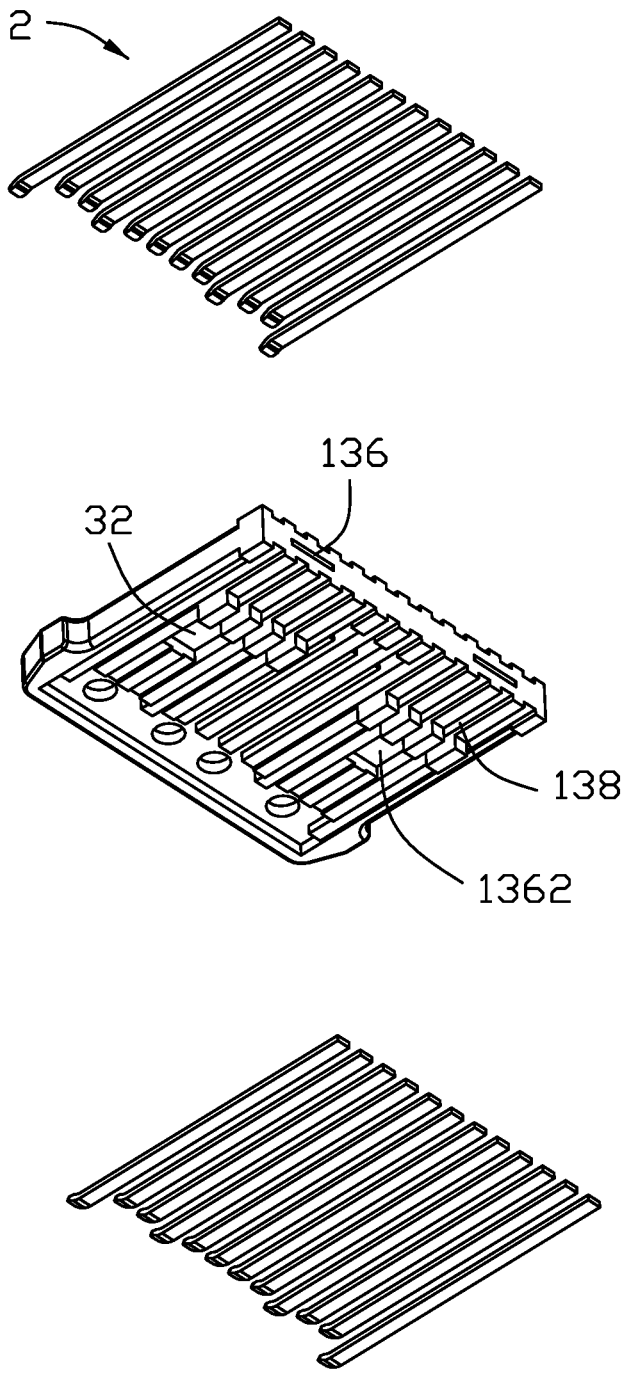
FIG. 8 is another view of the ceramic flat portion and the conductive terminals taken from FIG. 7.
Figure 9:
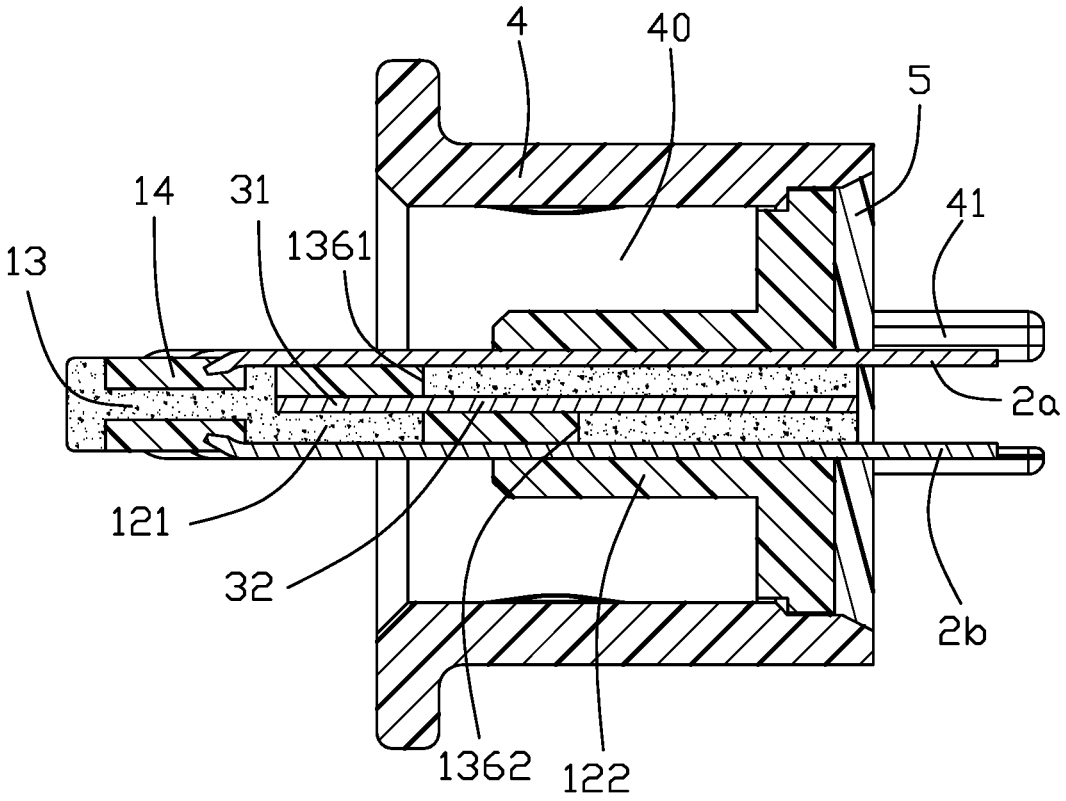
FIG. 9 is a cross-sectional view of the electrical connector taken along line 9-9 in FIG. 1.
Figure 10:
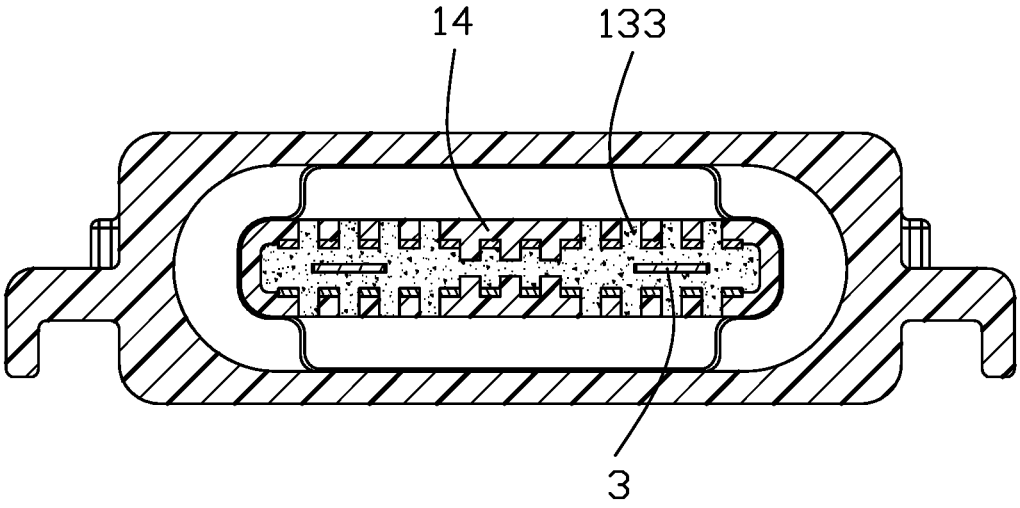
FIG. 10 is a cross-sectional view of the electrical connector taken along line 10-10 in FIG. 1.
Figure 11:
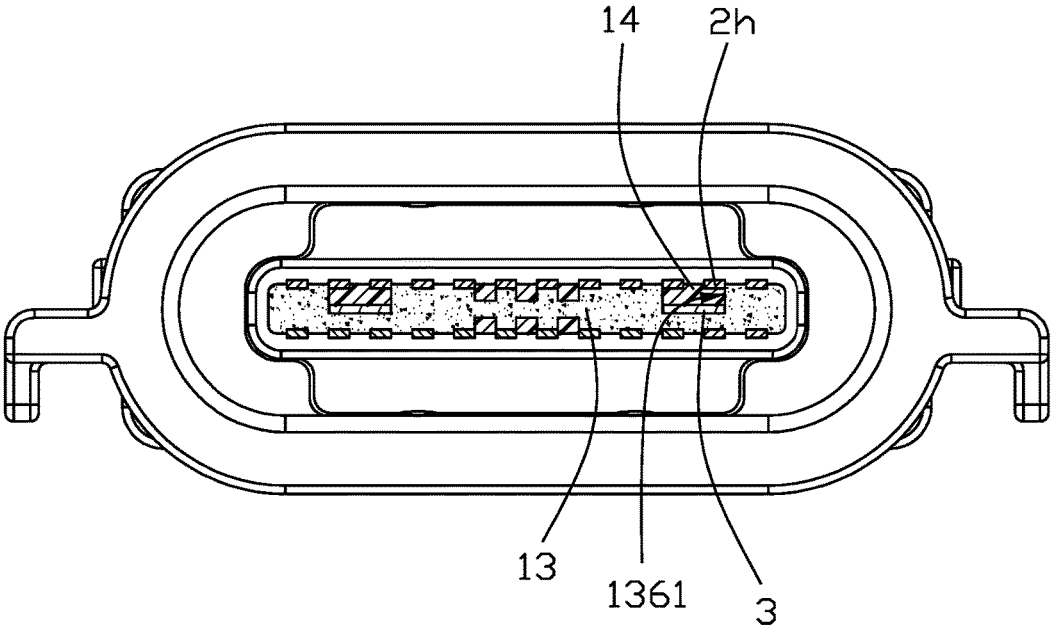
FIG. 11 is a cross-sectional view of the electrical connector taken along line 11-11 in FIG. 1.
Figure 12:
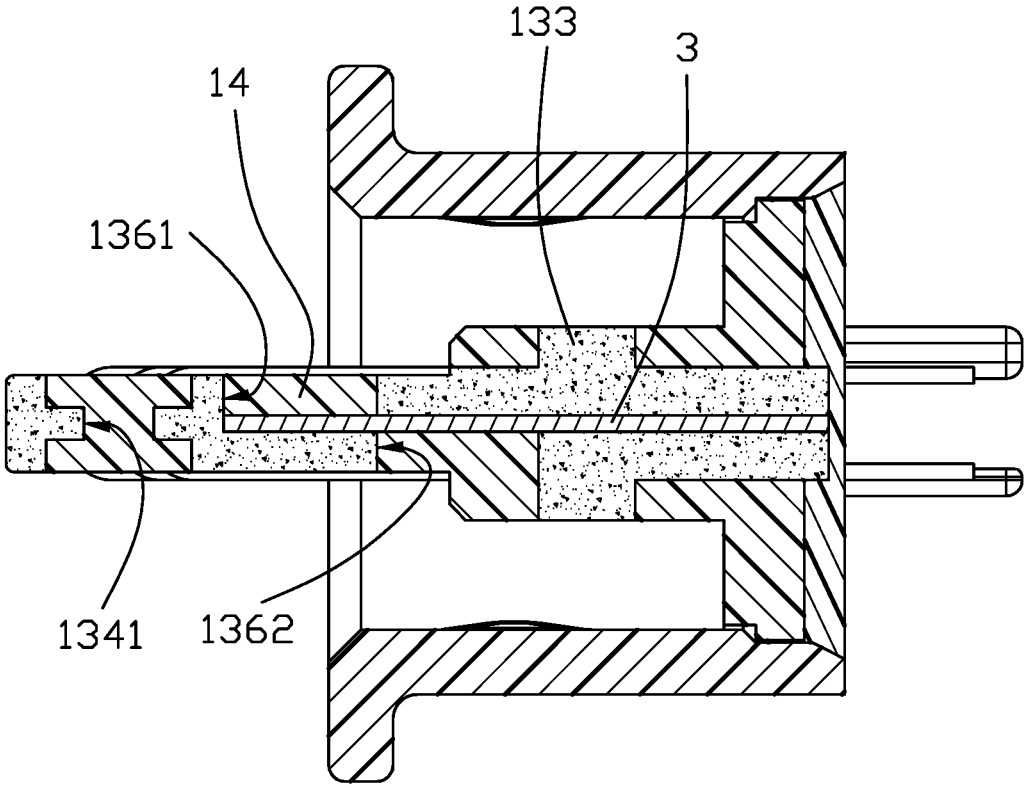
FIG. 12 is a cross-sectional view of the electrical connector taken along line 12-12 in FIG. 1.

Referring to FIGS. 3 to 9, the insulative housing includes a ceramic flat portion 13 made of ceramic materials and an insulator 14 made of insulative materials. The ceramic flat portion 13 includes an upper surface 137and a lower surface 138. The conductive terminals 2 are disposed in the upper (mating) surface 137 and the lower (mating) surface 138. The insulator 14 is poured into the ceramic flat portion 13 and the conductive terminals 2 to form the base portion 11 and the rear thickened portion 122. The ceramic flat portion 13 includes a front surrounding wall 131 and a pair of lateral surrounding walls 132 located at the upper surface 137 and the lower surface 138. The front surrounding 131 and the lateral surrounding walls 132 are higher than the middle portion surrounded by the front surrounding 131 and the lateral surrounding walls 132. The ceramic flat portion 13 includes a row of ribs 133 located at the middle portion and isolated from each other. Referring to FIGS. 4 to 6, the ceramic flat portion 13 includes a plurality of shallow terminal slots 135 located at the upper surface 137 and the lower surface 138. The shallow terminal slots 135 are disposed in the adjacent ribs 133. The eight ribs 133 located at two lateral sides are disposed in a middle place in a longitude direction and the three ribs 133 located at the eight ribs 133 are disposed in a rear end in the longitude direction.

A top surface and a lower surface of each rib 133 are parallel with that of the rear thickened portion 122. The base portion 11 is integrated with a rear end of the mating tongue 12 to suppress the contact module 1. The ceramic flat portion 13 includes a transverse recess 134 located behind the front surrounding wall 131 in a transverse direction perpendicular to the longitude direction and a number of through holes 1341 located at the transverse recess 134. The insulator 14 encloses the transverse recess 134 and the through holes 1341. A front end of each conductive terminal 2 bends downwardly and is embedded in the insulator 14. After the insulator 14 is integrated with the conductive terminals 2, two rows of the conductive terminals 2 are flush with the ceramic flat portion 13, especially the front surrounding wall 131 and the lateral surrounding walls 132 to form the front tongue 121.

Referring to FIGS. 5 to 6, the shallow terminal slots 135 include a pair of ground terminal slots 1351 located at the outermost side, two adjacent pairs of high-frequency signal slots 1352, a pair of power terminal slots 1353 located inside the high-frequency signal slots 1352, and a number of signal slots located between the pair of power terminal slots 1353. The ground terminal slots 1351 and the power terminal slots 1353 stretch longer than other terminal slots in the longitude direction.

Referring to FIGS. 5 to 8, the ceramic flat portion 13 includes a pair of (shielding plate) receiving slots 136 extending through a rear end of the ceramic flat portion corresponding to the upper and lower rows of high-frequency signal terminal slots 1352. The receiving slot 136 penetrates a rear surface of the rear thickened portion 122 and extends to the front tongue 121. The receiving slots 136 include a pair of first exposed holes 1361 penetrating the upper surface 137 and a pair of second exposed holes 1362 penetrating the lower surface 138 and located behind the first exposed holes 1361. The first exposed holes 1361and the second exposed holes 1362 are located at a front end of the ribs 133.

Referring to FIGS. 5 to 6, the shielding plates 3 are arranged in a pair in symmetry in the transverse direction. Each shielding shell 3 includes a front portion 31 exposed to the first exposed hole 1361 and a tail 32 exposed to the second exposed hole 1362. The width of the first portion 31 is not larger than that of the tail 32 in the transverse direction.

Referring to FIGS. 5 to 8, the conductive terminals 2 are arranged in line. Each conductive terminal 2 is initially clamped between adjacent ribs 133. A soldering portion 22 of each conductive terminal 2 extends outwardly from the ceramic flat portion 13. The conductive terminals 2 include a row of upper terminals 2a affixed to the upper surface 137 and a row of lower terminals 2b affixed to the lower surface 138. Each conductive terminal 2 includes a fixed portion 22 affixed to the rear thickened portion 122 and the base portion 11, a contacting portion 21 extending forwardly from the fixed portion 22 and exposed to the front tongue 121, and the soldering portion 23. The conductive terminals are arranged in two rows, and the soldering portions extend linearly rearwardly and are respectively soldered to both surfaces of the circuit board (not shown). Each row of conductive terminals 2 include a pair of ground terminals 2*g* located at the outermost side, two adjacent high-frequency signal terminals 2*h* located inside the pair of the ground terminals 2*g*, a pair of power terminals 2*p* located inside the high-frequency signal terminals 2*h*, and a number of signal terminals located between the pair of power terminals 2*p*. The ground terminals 2*g* are affixed in the ground terminal slots 1351. The power terminals 2*p* are affixed in the power terminal slots 1353. The high-frequency signal terminals 2*h* are affixed in the high-frequency signal terminal slots 1352. The insulator 14 is powered between the conductive terminals 2 and the ceramic flat portion 13 preventing the high-frequency signal terminals 2*h* and the shielding plates 3 contacting with each other.

Referring to FIGS. 1-3 and 9, the shielding shell 4 is an annular structure including a receiving room 40 and fixed to the base portion 11 and surrounding the mating tongue 12 to form a mating room therebetween. The shielding shell 4 includes two pair of soldering pins 41 located at two lateral sides and parallel with the soldering portions 23. The printed circuit board is clapped between each pair of soldering pins 41 in a vertical direction perpendicular to the transverse direction. The shielding shell 4 includes a pair of barriers 42 resisting a front surface of the base portion 11 preventing the contact module moving forwardly. In the present invention, the contact module 1 is assembled into the shield shell 4 from a rear-to-front direction until resisted by the barriers 42. A free end of the barrier 42 resists against the end of the rear thickened portion 122. Subsequently, the waterproof material is poured into the space between the rear edge of the shielding shell and the rear end surface of the base portion, thereby forming the sealer 5.

Compared with the prior art, the tongue portion affixing with the conductive terminals is made of ceramic materials, which can prevent the ceramic materials from melting and affect the performance of the product when the temperature is increased due to the transmission of a large current. At the same time the shielding plate is sandwiched between the pair of high-frequency signal terminals in the vertical direction to shield the upper and lower terminals, and the high frequency performance of the product can be achieved. In this invention, the insulator 14 is further applied upon the tongue portion so as to have the terminals exposed upon the mating surface of the tongue portion in a proper attachment. In other words, such a tongue portion is essentially a hybrid part composed of both resiliency and stiffness thereof so as to be properly received within the mating slot in a complementary plug connector during mating. In opposite, the pure ceramic type tongue portion of the receptacle connector used in the recent design may be relatively too stiff to properly mate with the plug connector. In this embodiment, notably the receiving slot 136 for receiving the shielding plate 3 is very slim and tiny, thus being difficult to be completely formed during forming the ceramic flat portion 13. Therefore, the first exposed hole 1361 and the second exposed hole 1362 are used to help forming completely the deepest end region of the slot 136. Understandably, such first exposed hole 1361 and second exposed hole 1362 will be filled with the material of the insulator 14 when the insulator 14 is applied upon the ceramic flat portion 13, thus not only enhancing integration between the ceramic flat portion 13 and the insulator 14 but also perfecting isolation between the shielding plate 3 and the corresponding high-frequency signal terminals 2*h*.

While the preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion and a mating tongue extending forwardly from the base portion;

a plurality of conductive terminals affixed to the insulative housing and exposed to two opposite surfaces of the insulative housing, the conductive terminals being arranged in upper terminals and lower terminals in two rows and each row including a plurality of high frequency signal terminals; and a pair of shielding plates affixed to the insulative housing; wherein the insulative housing has a pair of receiving slots at a peripheral edge thereof for inserting the shielding plates to shield between the two rows of conductive terminals.

2. The electrical connector as claimed in claim 1, wherein the mating tongue comprises a front tongue and a rear thickened portion, the front tongue is made of ceramic materials, and the rear thickened portion is made of insulative materials.

3. The electrical connector as claimed in claim 1, wherein the base portion and the mating tongue are both made of ceramic materials.

4. The electrical connector as claimed in claim 1, wherein each row of the conductive terminals comprise a ground terminal at an outermost side and a power terminal located inside the ground terminal, the high frequency signal terminals are located between the ground terminal and the power terminal, the receiving slots are located between the high frequency signal terminals of the two rows of the conductive terminals in a vertical direction, and the shielding plates are disposed in the receiving slots.

5. The electrical connector as claimed in claim 2, wherein each receiving slot penetrates a rear surface of the rear thickened portion into the front tongue.

6. The electrical connector as claimed in claim 5, wherein the insulative housing comprises a ceramic flat portion and an insulator integrated with the insulative housing, each receiving slot comprises a pair of first exposed holes penetrating an upper surface of the ceramic flat portion and a pair of second exposed holes penetrating a lower surface of the ceramic flat portion and located behind the first exposed holes, each shielding plate comprises a front portion exposed to the first exposed hole and a tail exposed to the second exposed hole, and the width of the front portion is less than that of the tail in a transverse direction perpendicular to the vertical direction.

7. The electrical connector as claimed in claim 6, wherein the ceramic flat portion comprises a row of through holes at a front edge thereof, and the insulator encloses the front edge and fills in the through holes.

8. The electrical connector as claimed in claim 2, wherein the ceramic flat portion comprises a row of ribs isolated from each other and located at an upper surface and a lower surface thereof, the conductive terminals are disposed in adjacent ribs, a top surface of the rib located at the upper surface of the ceramic flat portion is higher than a top surface of the upper terminal and parallel with a top surface of the rear thickened portion, a bottom surface of the rib located at the lower surface of the ceramic flat portion is lower than a bottom surface of the lower terminal and parallel with a bottom surface of the rear thickened portion, and the base portion is integrated with a rear end of the mating tongue.

9. The electrical connector as claimed in claim 1, wherein each conductive terminal comprises a contacting portion exposed to the front tongue and a soldering portion extending outwardly from the base portion, a front end of the contacting portion of the ground terminal and a front end of the contacting portion of the power terminal protrude forwardly from the other conductive terminals, the front end of the contacting portion of the ground terminal protrudes forwardly from the power terminal, the front end of the contacting portion of the power terminal protrudes forwardly from the high frequency signal terminal, and the front end of the conductive terminals are embedded in the insulator.

10. The electrical connector as claimed in claim 1, further comprising a shielding shell enclosing the insulative housing, the shielding shell including a pair of barriers isolated from each other and located at a rear end thereof, the barriers resisting against a front surface of the base portion.

11. An electrical connector comprising:

a ceramic flat portion including in a vertical direction two opposite mating surfaces each with a plurality of terminal slots therein;

a plurality of terminals respectively received in the corresponding terminal slots and exposed upon the corresponding surface;

an insulator integrally over-molded upon the ceramic flat portion so as to efficiently retain the terminals thereto; wherein the ceramic flat portion and the insulator commonly form an insulative housing including a front tongue and a rear thickened portion, and in the front tongue said insulator defines opposite surfaces coplanar with the opposite mating surfaces of the ceramic flat portion, respectively.

12. The electrical connector as claimed in claim 11, wherein in the thickened portion said ceramic flat portion includes a plurality of ribs extending beyond the corresponding mating surface in said vertical direction, and the insulator surrounds said ribs horizontally while exposing said ribs to an exterior in the vertical direction.

13. The electrical connector as claimed in claim 11, wherein a pair of shielding plates are received within corresponding receiving slots in the ceramic flat portion and aligned with corresponding signal terminals of said terminals in the vertical direction.

14. The electrical connector as claimed in claim 13, wherein said ceramic flat portion forms a first exposed hole exposed to one of said opposite mating surfaces and a second exposed hole exposed to the other of said opposite mating surfaces, said first exposed hole and said second exposed hole communicating commonly with the receiving slot in the vertical direction and further with each other in a front-to-back direction perpendicular to said vertical direction.

15. The electrical connector as claimed in claim 14, wherein said first exposed hole and said second exposed hole are filled with the insulator.

16. The electrical connector as claimed in claim 11, wherein said ceramic flat portion forms in the vertical direction a plurality of through holes completely filled within the insulator.

17. An electrical connector comprising:

a ceramic flat portion including in a vertical direction two opposite mating surfaces each with a plurality of terminal slots therein;

a plurality of terminals respectively received in the corresponding terminal slots and exposed upon the corresponding surface; wherein said ceramic flat portion includes a receiving slot located between two opposite mating surfaces and extending along a front-to-back direction perpendicular to said vertical direction through a rear face of said ceramic flat portion; and a metallic shielding plate received within the receiving slot from the rear face of the ceramic flat portion and aligned with corresponding signal terminals of said terminals in the vertical direction.

18. The electrical connector as claimed in claim 17, wherein said ceramic flat portion forms in one of said opposite mating surfaces a first exposed hole communicating with the receiving slot in the vertical direction.

19. The electrical connector as claimed in claim 18, wherein an edge of said first exposed hole is aligned with an inner end of said receiving slot.

20. The electrical connector as claimed in claim 18, wherein said ceramic flat portion further forms in the other of said opposite mating surfaces a second exposed hole communicating with the receiving slot in the vertical direction, and said first exposed hole and said second exposed hole further communicate with each other in a front-to-back direction perpendicular to said vertical direction.

* * * * *